US005779501A

United States Patent [19]

Hotra et al.

[11] Patent Number: 5,779,501

[45] Date of Patent: Jul. 14, 1998

[54] CONNECTOR

[75] Inventors: Zenon Hotra, Troy; Brian M. Hood, Clinton Township, both of Mich.

[73] Assignee: UT Automotive Dearborn, Inc., Dearborn, Mich.

[21] Appl. No.: 730,533

[22] Filed: Oct. 11, 1996

[51] Int. Cl.[6] ..... H01R 13/40

[52] U.S. Cl. ..... 439/595; 439/744

[58] Field of Search ..... 439/595, 752, 439/744

[56] References Cited

U.S. PATENT DOCUMENTS 5,100,345 3/1992 Endo et al. ..... 439/595

5,100,346 3/1992 McCardell ..... 439/595

5,522,740 6/1996 Plocek et al. ..... 439/752

*Primary Examiner*—Neil Abrams

*Assistant Examiner*—T. C. Patel

*Attorney, Agent, or Firm*—Howard & Howard

[57] ABSTRACT

A connector for holding at least one terminal includes a housing and a separate finger assembly. The housing defines a channel and a slot there below. Upon insertion of the finger assembly into the slot, a flexible finger extends into the channel. Upon insertion into the channel, the terminal contacts the finger and causes the finger to flex out of the channel into the slot. Upon full insertion of the terminal, the finger rebounds back into the channel and securely holds the terminal within the housing.

20 Claims, 1 Drawing Sheet

CONNECTOR

TECHNICAL FIELD

The present invention relates to a wire harness and, more particularly, to an improved connector for holding an electrical terminal.

BACKGROUND OF THE INVENTION

Electrical connectors are used in a wide variety of applications, such as in wire harnesses in automotive applications. Wire harnesses are large bundles of wire used to interconnect the electrical components of a vehicle to their respective controls and power source. Generally, the wires have electrical terminals, either male or female, attached at both ends.

Connectors serve two functions within the wire harness. First, they electrically interconnect a plurality of electrical wires to perform various functions by securely holding a male terminal in electrical contact with a female terminal, so that electric current may pass through the associated wire. Second, since the terminal environment includes corrosive chemicals, flying objects, and high temperatures, that might damage them, it is industry practice to protect them with connectors.

Many such connectors include a housing and a wedge, also called a spacer. The housing has a plurality of longitudinally extending channels, a slot below the channels, and a plurality of integral longitudinally extending, flexible locking fingers disposed a distance within each channel. Thus, the fingers and the housing are one piece.

The terminal is inserted into the associated channel. As the terminal contacts the finger, the finger flexes out of the channel and into the slot to allow the terminal to be inserted completely within the channel. Once fully inserted, the finger engages the terminal within the channel, thus securing the terminal within the connector. However, if the finger is caused to flex outwardly again the terminal can be removed. This is necessary in case the connector was misassembled or requires repair.

Next, the wedge is inserted in the housing slot below the fingers. The wedge prevents the fingers from flexing downwardly, because the wedge is below the fingers. Consequently, the wedge securely locks the terminals into the housing. The wedge also assures the assembler that the terminals are fully inserted. If any one terminal is not fully inserted, the corresponding finger will be within the slot, and prevents the wedge from being inserted.

Since the number of electronic systems in automobiles has increased, the number of wires to be included in automobiles has increased. However, space within the car has not increased; therefore, smaller electronic components, such as connectors, are needed. Typically, the connectors are injection molded from plastic materials, and the tools and dies used to form the connectors are extremely complex. The molding process requires repeated insertion and removal of metal bars into the housing longitudinally to form the channels and the fingers. Since the bars must extend along the length of the housing, the bars are comparatively long and thin. As a result, it is known that the tooling is delicate and breakable. As connectors get smaller, they are more difficult to manufacture, since they require smaller channels and, consequently, fingers be molded therefrom. The tools also become more delicate and expensive. At or below a particular size, miniaturization becomes impossible since the size prohibits the forming of the channels and fingers.

In addition, the cycle time for forming the connectors is primarily driven by the time it takes to open and close the mold and to fill the mold. When forming the connectors, as mentioned above, the mold must open and close along the length of the housing repeatedly. Since the length is the largest dimension of the housing, the cycle times are high.

Yet another problem with the current connectors is that when the connector is molded, a flash of material may form at a critical part of the finger, such as where it engages the terminal. This can occur due to the mold halves not fully meeting at this position on the housing. If the finger is formed with a significant amount of flash in this location, it may prevent full insertion of the terminal into the connector, which is unacceptable.

In addition, the material for the housing is currently dictated by the specifications for the finger, since it is the critical piece of the connector. In many cases, more exotic and expensive plastics are the only ones capable of providing the necessary modulus of elasticity for the fingers. However, the bulk of the material for the connector does not require the use of such materials. Furthermore, when multiple channel connectors which hold more than one terminal are formed, if a single finger is broken in the connector, the entire connector may need to be scrapped. This increases operating costs.

Therefore, an improved connector is sought, which is easy to manufacture, allows increased miniaturization of the connector, prevents flash at critical locations, and decreases material and operating costs.

SUMMARY

According to an embodiment of the present invention, a connector includes a housing and a separate means for removably securing a terminal. The housing includes a longitudinally extending channel and a longitudinally extending slot adjacent thereto. Upon insertion of the means for removably securing into the slot, the means extends into the channel. If a terminal is inserted into the channel of the housing the means removably secures the terminal within the housing.

In one embodiment the separate means for removably securing is a separate finger assembly including a plurality of spaced, flexible fingers extending from an edge. Upon insertion of the finger assembly into the slot each finger extends into the associated channel. If a terminal is inserted into the channel at the opposed end to the edge, the finger flexes to allow entry of the terminal. At full insertion, the finger rebounds to prevent exit of the terminal.

In another embodiment, the invention further includes an abutment means or wedge to be inserted into the slot below the finger assembly. The wedge prevents the fingers from flexing to allow exit of the terminals. The principal advantage of the present invention is that the connector can be made smaller and cheaper by making the finger assembly and the housing two separate pieces.

BEST MODE FOR CARRYING OUT AM EMBODIMENT THE INVENTION

Figure 1:
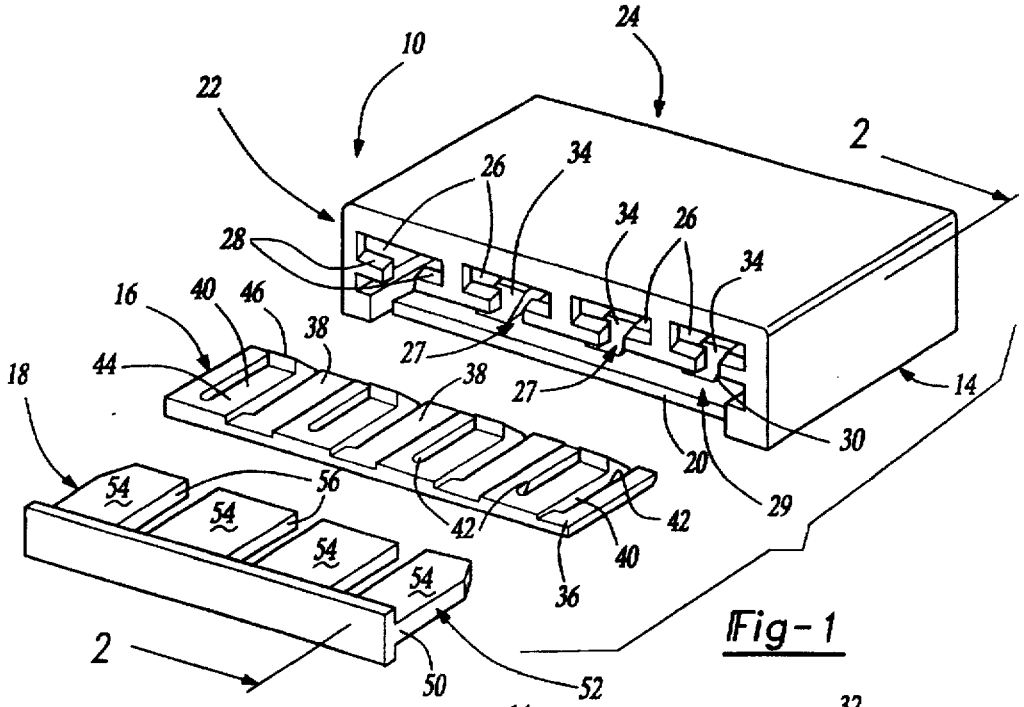
FIG. 1 is a perspective view of a connector of the present invention prior to assembly.
Figure 2:
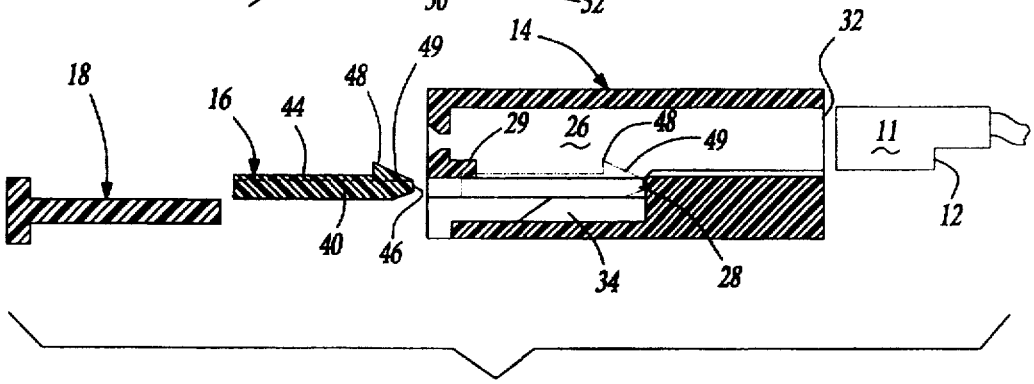
FIG. 2 is a cross-sectional view along line 2—2 of FIG. 1 of the connector of the present invention.

Referring to FIGS. 1 and 2, a connector 10 is for use with a terminal 11 (as shown in FIG. 2). The terminal 11 includes a shoulder 12 and is attached to a wire 13. The connector 10 includes a housing 14, a separate finger assembly 16, and a T-shaped wedge 18.

The housing 14 is formed by a plurality of interconnected walls, such as a lower wall 20, as is known in the art. The housing 14 supports the other components of the connector 10. The housing 14 further includes a longitudinally extending axis L, a front end 22, and a spaced opposed rear end 24. The walls of the housing 14 define a plurality of longitudinally extending channels 26. The channels 26 are aligned in a row across the width of the housing 14. The lower wall 20 includes a plurality of upwardly extending ridges 34 disposed between each of the channels 26, to form partially longitudinally extending slots 27 therebetween. The channels 26 are separated from the slots 27 by a divider 28. The divider 28 is a partially longitudinally extending wall.

The front end 22 of the housing includes an opening 30 of the channels 26 and the slots 27. At the opening 30 the slots 27 become one slot 29, and between the ridges 34 the width of the slots 27 register with the channels 26. The rear end 24 of the housing 14 includes a rear opening 32 of the channels 26.

The finger assembly 16 acts as a means for removably securing the terminal. The assembly 16 includes an edge 36 from which a plurality of platforms 38, and flexible fingers 40 longitudinally extend. The platforms 38 and fingers 40 alternate and have notches 42 disposed therebetween.

Each flexible finger 40 includes a fixed end 44 connected to the edge 36, an opposed free end 46, a protrusion 48 disposed between the ends, and a chamfered portion 49 between the protrusion 48 and the free end 46.

The T-shaped wedge 18 acts as an abutment means, which includes a first portion 50 which extends vertically, and a second portion 52 which extends longitudinally. The second portion is forked so that platforms 54 alternate with notches 56.

Use of the connector 10 will now be discussed. Referring to FIGS. 1 and 2, the finger assembly 16 is inserted through the front opening 30 into the slot 29 and the slots 27 in the housing 14. Once inserted the platforms 38 rest on top of the ridges 34 so that (as shown in phantom in FIG. 2) the protrusions 48 of each finger 40 extend into the channels 26. Thus, each finger 40 forms the lower wall of each channel 26. The edge 36 of the finger assembly 16 is below the divider 28.

Figure 3:
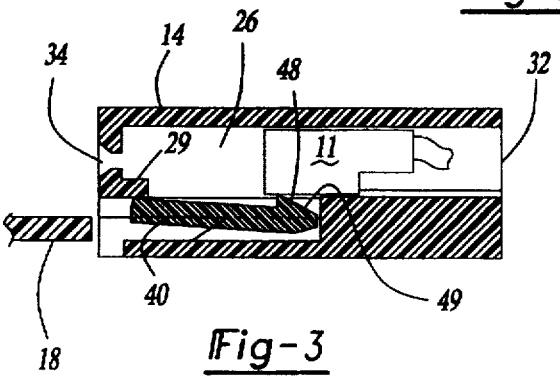
FIG. 3 is a cross-sectional view of the connector as shown in FIG. 2 during assembly where a terminal is partially inserted.
Figure 4:
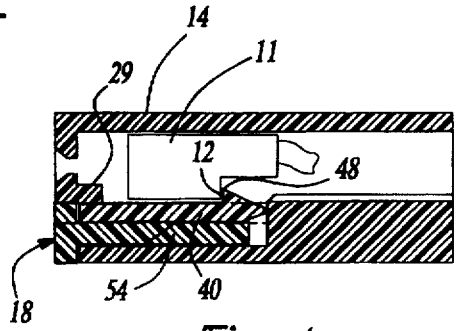
FIG. 4 is a cross-sectional view of the connector as shown in FIG. 3 during assembly where the terminal and a wedge are fully inserted.

Referring to FIG. 3, each terminal 11 is then inserted through the rear opening 32 into the channel 26. As the terminal 11 contacts the free end 46 of the finger 40, the edge 36 abuts against the divider 28 until the finger 40 flexes out of the channel 26 and into the slot 27. The chamfered portion 49 aids in inserting the terminal 11. Referring to FIG. 4, when the shoulder 12 of the terminal passes the protrusion 48, the finger 40 rebounds to its original position within the channel 26, and the terminal 11 is securely held within the housing 14. The remainder of the terminals 11 are inserted similarly in their respective channels 26.

Referring to FIGS. 1 and 4, the wedge 18 is then inserted through the front opening 30 into the slot 29, then slots 27. The second portion 52 of the wedge 18 is below the finger assembly 16. The notches 56 are formed so that when the wedge 18 is inserted into the slots 27 the ridges 34 are received into the notches 56. The platforms 54 are formed so that when the wedge 18 is inserted into the slots 27 the platforms 54 are aligned with and below the fingers 40. The wedge 18 secures the fingers 40 in the locked position by preventing their flexure. The wedge 18 further assures that the terminals are properly inserted, because if the terminals are not fully inserted, the corresponding finger will still be within the slot 27 and the wedge cannot be fully inserted. This provides a positive indication of the faulty assembly of the connector. However, when all the terminals are fully inserted and latched, the wedge 18 will slide fully into the slots 27.

Since the housing and finger assembly are separate, the housing, which accounts for the majority of the material for the connector, can be made of a less expensive material, while the smaller finger assembly can be made from another material. Thus minimizing cost. In addition, the material best suited for each of the components can be used instead of compromising in choosing the best material for the finger and not for the housing.

The housing can be injection molded using a variety of plastics which provide the necessary mechanical protection and support to the components, and the chemical and thermal protection desired. For example, commercially available nylon may be used.

The finger assembly can be injection molded using plastics with a high modulus of elasticity, so that the fingers are flexible but able to return to their initial position. For example, commercially available polybutyleneterapthalate or GTX 810/910 manufactured by General Electric may be used. The modulus of elasticity of the material chosen for the finger assembly 16 preferably is higher than that of the housing 14 material.

The principal advantage of the present invention is that the manufacture of small connectors is possible and easier than before. The ability to manufacture the housing and finger assembly separately allows smaller connectors to be built because smaller housings can be formed without the integral fingers. The metal bars needed to form housings without fingers will only form the channels, not the fingers therein. As a result, the metal bars used can be larger and more robust.

Manufacturing the finger assembly is much easier, because it can be molded with the mold opening in the vertical direction without using metal bars. Since this direction is small compared to the finger length, there are no concerns with having long delicate tooling, and the cycle time decreases. Furthermore, with the mold opening in the vertical direction it travels along the height of the finger assembly. The mold can be formed to close along the surface of the assembly without the protrusions. As a result, the mold closing point limits any flash produced to a non-critical area of the finger. Since no flash will form on the protrusion, concerns about the fingers preventing insertion of the terminal are minimal. Furthermore, the fingers may be continuously molded in a strip and cut to specific applications, thus making the manufacturing process faster and less expensive. Decreased tooling cost, finger breakage, and tooling lead time; smaller centerlines; and, tighter tolerances are typical benefits.

Another advantage is that operating costs for the connector will be less. If a finger is broken, only the finger assembly needs to be replaced. With the prior art connector, if a finger is broken the entire connector would need to be scrapped. Further, the present invention may lead to common parts across product lines, because many connectors utilize identical terminals and spacing, and would use the same terminal cavities, with the same finger assemblies.

While a particular invention has been described with reference to illustrated embodiments, various modifications of the illustrative embodiments, as well as additional embodiments of the invention, will be apparent to persons skilled in the art upon reference to this description without departing from the spirit and scope of the invention, as recited in the claims appended hereto. These modifications include, but are not limited to, changing the location and the geometry of the housing so that the terminals, finger assembly and wedge may be loaded in the front or rear opening and the top, bottom or sides of the connector. It is therefore contemplated that the appended claims will cover any such modification or embodiments that fall within the true scope of the invention.

We claim:

1. A connector for holding at least one terminal, comprising:

a housing including at least one channel for receiving the terminal and a slot adjacent to said channel;

a holding member that is separate from and received within said housing, said holding member having a portion that extends at least partially into said channel, said portion being moveable out of said channel in response to movement of the terminal within said channel; and an indicator member that is received into a predetermined position relative to said housing to visually indicate a secure connection between said housing and the terminal.

2. The connector of claim 1, wherein said holding member portion comprises a finger and said indicator member comprises a platform that is received in abutting engagement with said finger.

3. The connector of claim 1, wherein said housing includes a first surface and said indicator member has a first face and wherein said first face is aligned with said first surface only when said indicator member is fully received into said housing such that an alignment between said first surface and said first face visually indicates said secure connection.

4. The connector of claim 1, wherein said indicator member has a portion that is received into said slot and abuts said holding member portion so that said holding member portion cannot move out of said channel.

5. The connector of claim 1, wherein said housing is formed from a material having a first modulus of elasticity and said holding member is formed from a material having a second modulus of electricity, where the first modulus of elasticity is lower than the second modulus of electricity.

6. The connector of claim 5, wherein said housing material is nylon, and said holding member material is polybutyleneterapthalate.

7. The connector of claim 5, wherein said ho using material is nylon, and said holding member material is GTX 810/910.

8. A connector for holding at least one terminal, comprising:

a housing defining at least one channel and a slot adjacent to said channel:

a finger assembly including an edge and at least one finger extending from said edge said finger assembly being received into said housing such that said finger extends into said channel, and upon movement of the terminal within the channel, said edge remains stationary relative to said housing and said finger flexes in response to movement of the terminal: and a wedge that is received into said housing such that upon insertion of said wedge below said finger assembly said finger cannot flex.

9. The connector of claim 8, wherein said housing is formed from a material having a first modulus of elasticity and said finger assembly is formed from a material having a second modulus of electricity, said first modulus of elasticity being lower than said second modulus of electricity.

10. The connector of claim 8, wherein said finger further includes a protrusion.

11. The connector of claim 8, wherein said housing has an edge and said wedge has a face that is lined up with said edge only when said wedge is fully inserted into said housing and wherein alignment of said edge and said face visually indicates a secure connection with the terminal.

12. The connector of claim 8 wherein said housing further includes a plurality of spaced ridges extending from a lower wall; and said finger assembly further includes a plurality of fingers alternating with a plurality of platforms, and having notches therebetween, such that upon insertion of said finger assembly each platform rests on an associated ridge, and each finger extends into its associated channel.

13. The connector of claim 12 wherein said wedge includes a plurality of platforms alternating with a plurality of notches such that upon insertion of said wedge below said finger assembly said notches receive said wedges and said platforms do not allow the fingers to flex.

14. A. connector for holding at least one terminal, said connector comprising:

a housing including a plurality of channels, a plurality of spaced ridges extending from a lower wall such that a plurality of slots are formed beneath said channels;

a finger assembly including an edge and a plurality of fingers alternating with a plurality of platforms, said fingers and platforms extending from said edge, and having notches therebetween; and a wedge; such that upon insertion of said finger assembly each platform rests on an associated ridge; and each finger extends into its associated channel, upon movement of the terminal within the channel, said edge abuts said housing and said finger flexes responsive to movement of the terminal and such that upon insertion of said wedge below said finger assembly said fingers cannot flex.

15. The connector of claim 14, wherein said wedge, further includes a plurality of platforms alternating with a plurality of notches, such that upon insertion of said wedge below said finger assembly said notches receive said ridges and said platforms do not allow the fingers to flex.

16. The connector of claim 14, wherein said finger further includes a protrusion.

17. The connector of claim 14, wherein said housing has an edge and said wedge has a face that is lined up with said edge only when said wedge is fully received into said housing, said alignment visually indicating a secure connection with the terminal.

18. The connector of claim 14, wherein said housing is formed from a material having a first modulus of elasticity and said finger assembly is formed from a material having a second modulus of electricity, said first modulus of elasticity being lower than said second modulus of electricity.

19. The connector of claim 18, wherein said housing material is nylon, and said finger assembly material is polybutyleneterapthalate.

20. The connector of claim 18, wherein said housing material is nylon, and said finger assembly material is GTX 810/910.

* * * * *